US005963237A

United States Patent [19]

Ikkatai et al.

[11] Patent Number: 5,963,237

[45] Date of Patent: Oct. 5, 1999

[54] LIQUID REFILLING METHOD, LIQUID SUPPLYING APPARATUS, AND LIQUID JET RECORDING APPARATUS

[75] Inventors: Masatoshi Ikkatai; Yasuyuki Takanaka, both of Yokohama, Japan

[73] Assignee: Canon Kabushiki Kaisha, Tokyo, Japan

[21] Appl. No.: 08/844,325

[22] Filed: Apr. 18, 1997

[30] Foreign Application Priority Data

Apr. 25, 1996 [JP] Japan ..... 8-105171
Mar. 26, 1997 [JP] Japan ..... 9-073808

[51] Int. Cl.[6] ..... B41J 2/175

[52] U.S. Cl. ..... 347/85

[58] Field of Search ..... 347/85, 86, 87, 347/7, 89

[56] References Cited

U.S. PATENT DOCUMENTS

| | | | |
|---|---|---|---|
| 4,383,263 | 5/1983 | Ozawa et al. | 347/30 |
| 4,476,472 | 10/1984 | Aiba et al. | 347/86 |
| 4,639,738 | 1/1987 | Young et al. | 347/89 |
| 4,882,596 | 11/1989 | Tsuzuki et al. | 347/10 |
| 4,967,207 | 10/1990 | Ruder | 347/7 |
| 4,968,998 | 11/1990 | Allen | 347/7 |
| 5,136,305 | 8/1992 | Ims | 347/7 |
| 5,367,328 | 11/1994 | Erickson | 347/7 |
| 5,485,187 | 1/1996 | Okamura et al. | 347/85 |
| 5,619,238 | 4/1997 | Higuma et al. | 347/86 |
| 5,663,754 | 9/1997 | Lorenze et al. | 347/87 |

FOREIGN PATENT DOCUMENTS

| | | |
|---|---|---|
| 62-109646 | 5/1987 | Japan . |
| 7-025025 | 1/1995 | Japan . |

*Primary Examiner*—N. Le
*Assistant Examiner*—Michael Nghiem
*Attorney, Agent, or Firm*—Fitzpatrick, Cella, Harper & Scinto

[57] ABSTRACT

A method for refilling liquid to a liquid supply path is provided with a sub-tank for supplying the liquid by retaining it temporarily and inducing the air outside into the sub-tank. This method comprises the steps of making the sub-tank a closed space and filling the liquid while reducing pressure in the sub-tank. With the application of this method, liquid can be supplied stably. Also, by use of a pump serving as means for generating negative pressure in the sub-tank, which can be installed on a path different from the liquid supply path, the structure of the liquid supply path becomes simpler to make it easier to avoid liquid leakage or other operational difficulties for the enhancement of a stabilized supply of liquid.

16 Claims, 6 Drawing Sheets

LIQUID REFILLING METHOD, LIQUID SUPPLYING APPARATUS, AND LIQUID JET RECORDING APPARATUS

BACKGROUND OF THE INVENTION

1. Field of the Invention

The present invention relates to a method for refilling liquid, which is preferably applicable to the ink supplying system of an ink jet recording apparatus, for example. The invention also relates to a liquid supplying apparatus, and a liquid jet recording apparatus.

2. Related Background Art

Technologies and techniques related to the liquid supply by use of liquid supply paths are utilized for various fields. As one example thereof, an ink jet recording apparatus can be cited. This apparatus records on a recording medium by discharging ink droplets from its recording head.

Since the ink jet recording apparatus records by discharging ink, there is a need for supplying ink to its recording head at all times to make it up as it is consumed for the intended operation. As methods for supplying ink to the recording head, there are known three methods given below according to a rough classification.

(1) A method for mounting an ink tank wherein the ink tank is detachably mounted on a carriage having a recording head installed on it, and the ink tank is connected to the ink supply inlet of the recording head at the same time.

As an ink tank used for this method, there is known a structure where a porous body, such as a sponge, is placed in it to store ink, with inclusion of an air conduit port to draw in the air from the outside for the smooth flow of ink during the printing operation.

(2) The so-called pit in method wherein a tank capable of storing a large amount of ink (hereinafter, referred to as a large tank) is provided, and at the same time, a head cartridge, which is formed by an ink tank and a recording head together, is mounted on a carriage so that ink is refilled by connecting the ink tank of the head cartridge with the large tank in a predetermined position to which the carriage travels.

(3) A method for refilling ink by means of a mechanism wherein a large ink tank is installed integrally with a recording apparatus main body, and ink path is formed by tubes or the like between the tank and a head cartridge, while arranging the mechanism on the ink path to supply ink to the head cartridge.

However, with a view to recording on a large-sized paper sheet or to refilling liquid for an apparatus that executes recording in a large volume, there are the problems given below with regard to each of the conventional techniques.

First, for the aforesaid method whereby to install a tank, the size of the tank is automatically limited because it should be mounted on a carriage, thus the storage of ink in the tank being restricted accordingly. This results in a problem that the cartridge should be replaced more frequently.

Second, for the aforesaid pit in method, ink remains tend to be varied with respect to a space (volume) to be filled in, and also, it is practically difficult to supply a specific amount of ink in good precision. In order to solve such problems, a system (an overflow system) should be provided for the collection of ink that has been supplied more than a predetermined amount or ink supply should be made extremely small in consideration of the anticipated variation thereof. For the former, however, the problem is that the apparatus should be made larger in consideration of its future use, and also, the invitation of wasteful consumption of ink is inevitable. For the latter, the problem is that along the increased frequencies of ink supply, the idle time becomes longer while recording is in operation, making its throughput lower after all.

Then, third, the method for refilling ink by a mechanism arranged on the ink path to supply ink necessitates ink to pass such mechanism. Therefore, it becomes difficult to remove dust particles or the like completely. Particularly, with use of a mechanism that supplies ink by squeezing the tube, component such as oil in rubber is dissolved, because the tube is always depressed. The dissolved oil adheres to the nozzles of a recording head. Such oil is solidified to bring about nozzle clogging or many other drawbacks.

With a view to solving these problems, the present invention is designed. It is an object of the invention to provide a liquid supplying method capable of reliably and easily executing liquid supply in the liquid supply paths, and also, to provide a liquid supplying apparatus therefor.

It is another object of the invention to provide a liquid jet recording apparatus capable of performing a stable recording without nozzle clogging of the liquid jet head by applying the aforesaid liquid supplying method and apparatus to the liquid jet recording apparatus provided with the liquid jet head.

SUMMARY OF THE INVENTION

In order to achieve the objects described above, a method for refilling liquid of the present invention comprises the steps of holding liquid temporarily and inducing the air outside to refilling it to the liquid supply path having a sub-tank arranged thereon for the liquid supply, wherein the sub-tank is made a closed space, and liquid is filled in while the pressure in the sub-tank is being reduced.

Also, it may be possible to reduce the pressure in the sub-tank by use of negative pressure generating means arranged on the path different from the liquid supply path described above. In this case, the pressure in the sub-tank may be reduced by exhausting the air in the sub-tank.

Further, it may be possible to open the sub-tank to the air outside after liquid having been refilled in the sub-tank or to provide a liquid jet head capable of discharging liquid, which is supplied from the sub-tank to the liquid supply path, to a recording medium from the nozzles of the head.

The liquid jet recording apparatus of the present invention, which is provided with a sub-tank capable of supplying liquid to liquid supply path by holding liquid temporarily, while inducing the air outside to it, comprises means for making the sub-tank a closed space; negative pressure generating means for reducing pressure in the sub-tank in order to refill liquid to the sub-tank; and means for making the refilled liquid suppliable from the sub-tank.

It may be possible to arrange the negative pressure generating means in the path different from the liquid supply path. In this case, a pump may be used for exhausting the air in the sub-tank as means for generating negative pressure.

Further, it may be possible to provide an air releasing valve for the sub-tank or means for detecting liquid amount for the sub-tank to decide on the execution of liquid refilling.

Then, the liquid jet recording apparatus of the present invention is provided with the aforesaid liquid supply apparatus of the present invention, and a liquid jet head may be arranged on the downstream end of the liquid supply path for recording by discharging liquid from its nozzles to a recording medium.

More specifically, the liquid jet recording apparatus is such that it comprises a liquid jet head unit to record by discharging liquid to a recording medium; a sub-tank, which is arranged to temporarily hold liquid to be supplied to the jet head unit, and which is also provided with an air releasing valve capable of inducing the air outside; a main tank that stores liquid to be refilled to the sub-tank; a first liquid supply path that connects the sub-tank and the main tank; a second liquid supply path having a valve that controls the connection between the jet head unit and the sub-tank; and a negative pressure generating path for connecting the sub-tank and the pump.

In accordance with the present invention structured as described above, liquid in the liquid supply path is carried to the down stream side through the sub-tank. When liquid is refilled to the sub-tank, the sub-tank is closed to the air outside, and pressure in it is reduced by use of negative pressure generating means arranged on the path different from the liquid supply path. Therefore, it is possible to materialize the liquid refilling stably with a simple structure of the liquid supply path. Here, in particular, negative pressure generating means can minimize the loss of its force to generate negative pressure by exhausting only the air in the sub-tank, thus making it possible to shorten the time required for refilling liquid.

Also, by the application of the method for refilling liquid of the present invention to the liquid jet recording apparatus where its jet head is arranged on the downstream end of the liquid supply path, it is possible to reduce the creation of foreign particles in the liquid supply path. Thus, the occurrence of nozzle clogging of the liquid jet head becomes rare.

In this respect, the "closing" referred to in the description of the present invention means a closed condition to the air outside. In other words, although the liquid jet head is open to the air outside in one form or another at the downstream end of the liquid supply path, it means that the closed condition referred to in the specification hereof is present if only the connection between the sub-tank and this particular portion is shut off even when it is connected with any other portions.

DETAILED DESCRIPTION OF THE PREFERRED EMBODIMENTS

Now, with reference to the accompanying drawings, the description will be made of the embodiments in accordance with the present invention.

Figure 1:
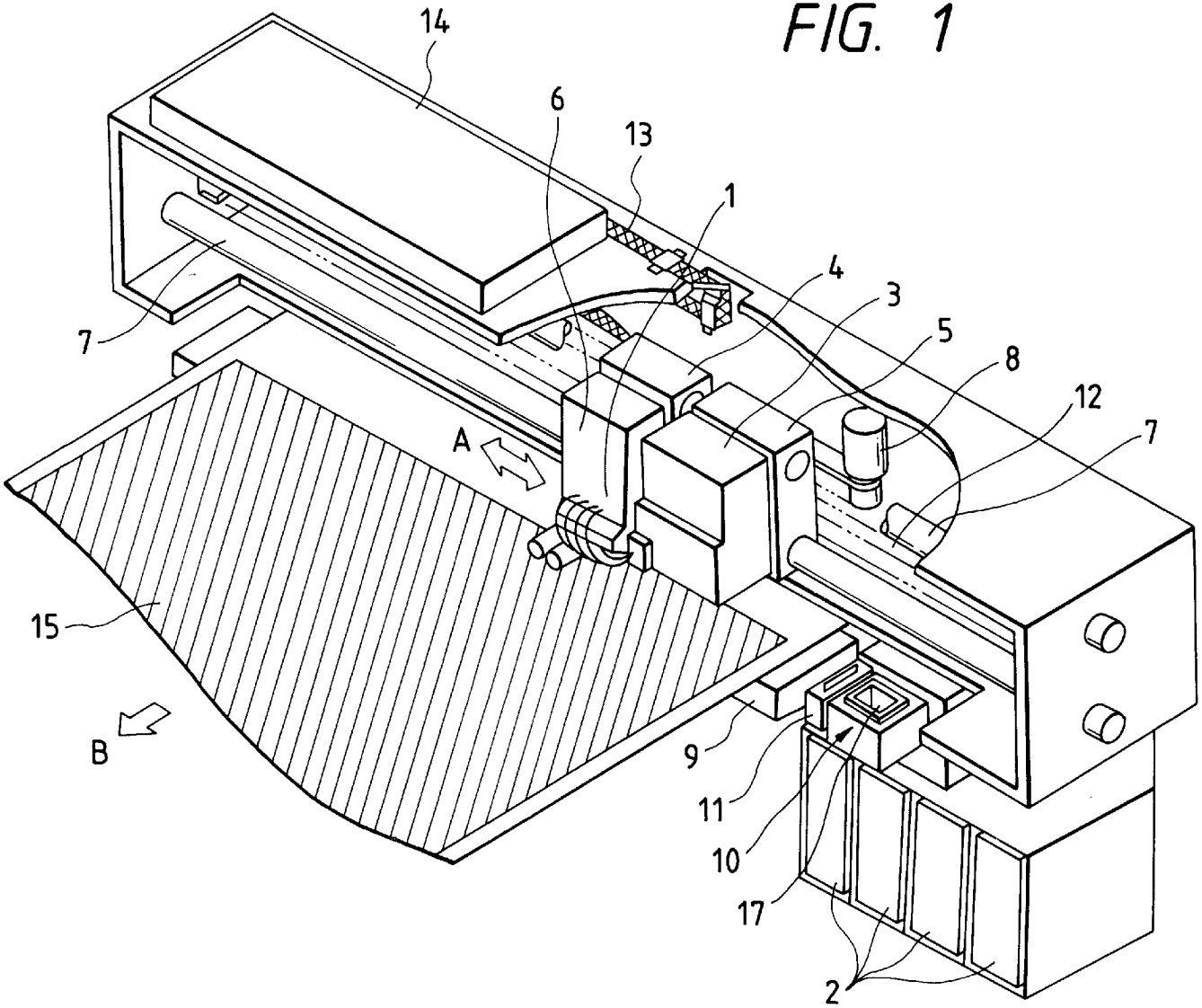
FIG. 1 is a view which shows the outer appearance of one embodiment of the liquid jet recording apparatus to which the liquid supplying apparatus of the present invention is applicable.

FIG. 1 is a perspective view which shows the outer appearance of an ink jet color recording apparatus in accordance with a first embodiment of the liquid jet recording apparatus to which the liquid supplying apparatus of the present invention is applicable.

As shown in FIG. 1, a head carriage 4 and a supply carriage 5 are fitted slidably on two rails 7, which are arranged in parallel to each other, for use of scanning in the direction indicated by arrows A. On the head carriage 4, an ink jet unit 1 is mounted to discharge ink in accordance with recording signals.

The ink jet unit 1 is provided with a plurality of nozzles arranged per color for ink of four colors, cyan, magenta, yellow, and black. For each of the nozzles, an electrothermal transducing element is provided to generate thermal energy for use of ink discharge. To the interior of the ink jet unit 1, ink is supplied by means of capillary phenomenon of each nozzle. Ink maintains the state where each nozzle is filled with it by forming meniscus on the surface (hereinafter referred to as a nozzle surface) to which the nozzles of the ink jet unit 1 are open. In this state, when each of the electrothermal transducing elements is energized, ink on each electrothermal transducing element is heated to create foaming phenomenon. Here, the structure is arranged to discharge ink droplets from each of the nozzles by means of energy thus exerted by such foaming phenomenon. Also, the ink jet head unit 1 is covered by a head cover 6 together with a driving base board to drive the ink jet head unit 1. The driving base board of the ink jet head unit 1 is connected through a flat cable 13 to a base board box 14 that stores a control board and others to control the operation of the recording apparatus as a whole.

On the other hand, the supply carriage 5 has the sub-tank 3 mounted on it to supply ink to the ink jet head unit 1. The interior of the sub-tank 3 is divided into four chambers corresponding to each color ink. Each of the chambers is connected with the jet head unit 1 by means of rubber tubes, respectively. Further, on the lower part of the sub-tank 3, four main tanks 2 are arranged to retain ink to be supplied to the sub-tank 3. The main tank 2 has a larger capacity than that of the sub-tank 3. It is desirable to make the capacity thereof more than 100 $cm^3$ from the practical point of view. In case of the present embodiment, the main tank is arranged to store ink of 500 to 1,000 $cm^3$. Each of the main tanks 2 is arranged corresponding to each of color ink, and connected to each chamber of the sub-tank 3 by means of rubber tubes. In this way, ink stored in the main tank 2 is supplied to the sub-tank 3 and retained in it. Then, ink is supplied from the sub-tank 3 to the ink jet head unit 1. The ink path between the main tank 2 and the sub-tank 3, and the structure in the ink path will be described later in detail. Here, the tubes that connect the sub-tanks 3 and the main tanks 2 are covered by a protection member 12 all together with the flat cable 13. Also, each of the main tanks 2 is formed by a soft material (a flexible case or the like), and deformed in accordance with the reduction of ink in the main tank 2.

The head carriage 4 and the supply carriage 5 are coupled to a timing belt, respectively. These carriages are caused to reciprocate in the directions indicated by arrows A for main scanning by the rotation of the timing belt by means of a motor 8 for use of main scanning. In a position opposite to the nozzles of the ink jet unit 1, a platen 9 is arranged. A recording sheet 15 is carried on the platen 9 in the direction indicated by an arrow B. The conveyance of the recording sheet 15 is intermittently executed at a predetermined pitch per scan of the head cartridge 4. Between such conveyances intermittently executed, recording is made by discharging ink from the ink jet head unit 1.

Also, in the scanning area of the ink jet head unit 1, but outside the recording area for the recording sheet 15, a head recovery system 10 is arranged to face the ink jet head unit 1 for the maintenance of the discharge characteristics of ink from the ink jet head unit 1 in good condition. The head recovery system 10 is provided with a cap 17 for capping the jet head unit 1 and a blade 11 for cleaning the nozzle surface of the jet head unit 1. The position where the jet head unit 1 faces the cap 17 is defined as the home position thereof.

Now, in conjunction with FIG. 2 to FIG. 6, the description will be made of a liquid refilling system to be used for the liquid jet recording apparatus of the present invention.

First Embodiment

Figure 2:
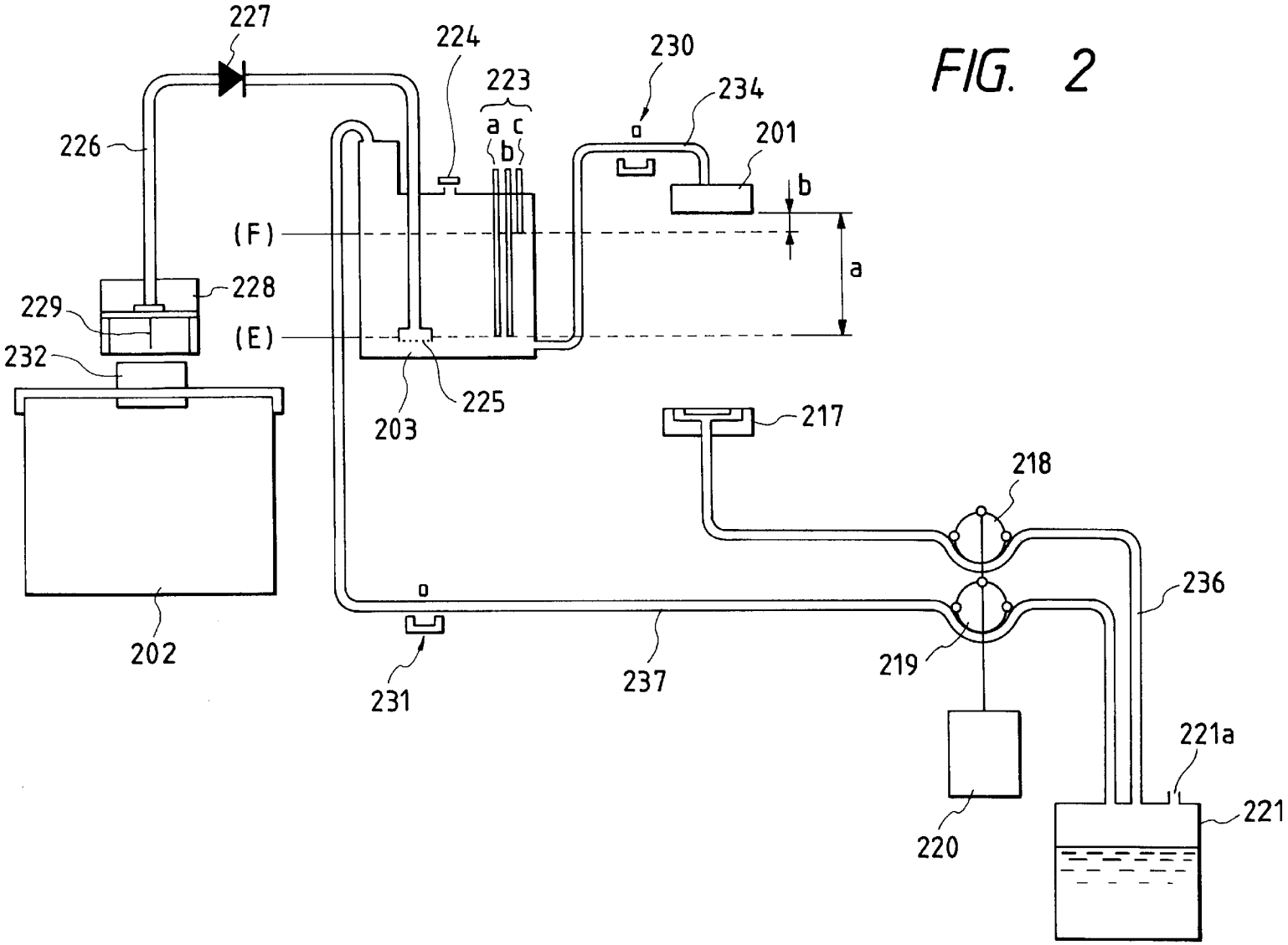
FIG. 2 is a view which shows a first embodiment of the ink path of the liquid jet recording apparatus to which the liquid supplying apparatus of the present invention is applicable.

FIG. 2 is a view which shows a first embodiment of the ink path of the liquid jet recording apparatus to which the liquid supply apparatus of the present invention is applicable. As described above, the ink jet recording apparatus of the present embodiment uses ink of plural colors. The ink path is arranged for each color, respectively. However, since ink paths are all the same, only one path is shown in FIG. 2 for ink of one color.

As shown in FIG. 2, a main tank 202 and a sub-tank 203 are connected by means of a main tube 226. At the edge of the side where the main tube 226 is connected to the main tank 202, a joint cap 228, which is provided with a hollow needle 229 like a syringe needle, is fixed. The joint cap 228 is installed on a rubber plug 232 fixed to the main tank 202. The needle 229 penetrates the rubber plug 232 to connect the main tube 226 and the main tank 202. The other end of the main tube 226 is inserted into the interior of the sub-tank 203. At the leading end thereof, a filter 225 is fixed to prevent foreign particles from flowing into the sub-tank 203. The leading end of the main tube 226 on the side inserted into the sub-tank 203 is positioned lower than the height at (E). Also, for the main tube 226, a one-way valve 227 is provided, which opens only when ink flows from the main tank 202 to the sub-tank 203. With this arrangement, ink is prevented from flowing backward from the sub-tank 203 to the main tank 202.

For the sub-tank 203, an ink remain detection sensor 223 is provided to detect ink remains in the sub-tank 203. The sensor comprises three electrode needles a, b, and c, each inserted from the upper end of the sub-tank 203. Of the needles a, b, and c, two of them, a and b, are inserted in such a manner that each tip thereof reaches the height at (E). The tip of the remaining electrode needle c is inserted to the height at (F). Then, a current of low voltage flows in each of the electrode needles a, b, and c. Conduction between each of the electrode needles a, b, and c are detected through ink. Thus, the ink amount in the sub-tank 203 is sensed. More specifically, if the liquid level of ink is lower than the height at (E), there is no conduction between the electrode needles a and b. When this condition is detected, ink is supplied from the main tank 202 to the sub-tank 203 as described later. If the liquid level of ink is higher than the height at (F), conduction takes place between the electrode needles a and c. If this conduction is detected, ink supply to the sub-tank 203 is suspended.

Also, at a position higher than the height at (F) in the upper part of the sub-tank 203, an air releasing valve 224 is arranged. This valve is driven by means of a driving source (not shown).

The bottom of the sub-tank 203 and the jet head unit 201 are connected by means of a sub-tube 234, making it possible to supply ink from the sub-tank 203 to the jet head unit 201 is conducted by the application of the capillary phenomenon of the nozzles of the jet head unit 201. Here, if the jet head unit 201 is positioned lower than the liquid level of ink in the sub-tank 203, ink leakage takes place. On the contrary, if the position of the jet head unit 201 is too high, no ink can be supplied to jet head unit 201. Therefore, it is necessary to position the jet head unit 201 so that meniscus is formed by ink on the nozzle surface to fill it in the nozzle. In accordance with the present embodiment, the jet head unit 201 is arranged at a position where the height a is 50 mm from the position at (E) with respect to the nozzle surface of the jet head unit 201, and the height b is 10 mm from the position at (F) with respect to the nozzle surface of the jet head unit 201.

On the other hand, a sub-tube closing valve 230 is provided for the sub-tube 234. This valve closes the ink path between the sub-tank 203 and the jet head unit 201 by depressing the sub-tube 234 to squeeze it. The sub-tube 234 is connected with the sub-tank 203 and the jet head unit 201 at the position lower than the height at (E).

The cap 217 for capping the jet head unit 201 is connected to a waste ink tank 221 by means of a suction tube 236. For the suction tube 236, a suction pump 218 is provided. When the suction pump 218 is driven in a state where the jet head unit 201 is capped by the cap 217, ink in the jet head unit 201 is sucked out to the cap 217, and then, stored in the waste ink tank 221 through the suction tube 236.

Further, the waste ink tank 221 and the sub-tank 203 are connected by means of a negative pressure tube 237. The negative pressure tube 237 is connected with the sub-tank 203 at a position higher than the height at (F). Also, for the negative pressure tube 237, a negative pressure tube closing valve 231 and a negative pressure generating pump 219 are provided to suck the gas (air) in the sub-tank 203 when the negative pressure generating pump 219 is driven in a state that the negative pressure closing valve 231 is open. The air thus sucked is exhausted to the outside from the aperture 221*a* of the waste ink tank. As described later, the interior of the negative pressure tube 237 is arranged to exhaust the air in the sub-tank. As a result, if only its end portion is open to the outside, the tube is not necessarily connected to the waste ink tank.

The suction pump 218 and the negative pressure generating pump 219 are tube pumps. Each of them is driven by a pump motor 220.

Figure 3:
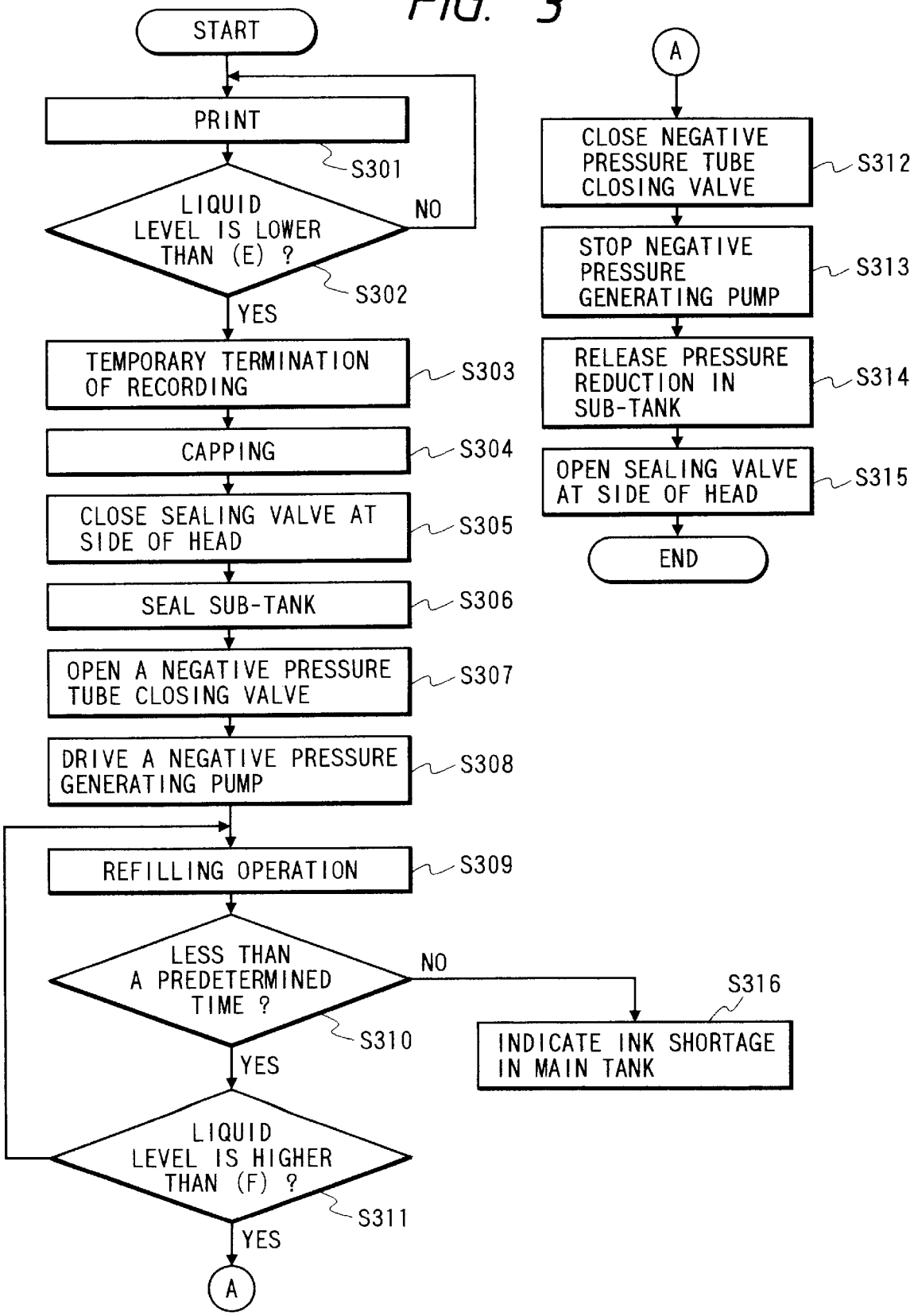
FIG. 3 is a flowchart which shows the liquid refilling operation of the liquid jet recording apparatus in accordance with the first embodiment of the present invention.

Now, with reference to a flowchart shown in FIG. 3, the liquid refilling operation of the present invention will be described on the basis of the structure as described above.

The liquid refilling operation is performed together with a recording operation. At first, ink is discharged from the jet head unit for printing (recording) on a recording sheet in accordance with recording signals, while repeating the reciprocation of the jet head unit 201 for scanning and the pitch feed of the recording sheet (S301). At this juncture, the sub-tube closing valve 230 and the air releasing valve 224 are open. Also, the suction pump 218 and the negative pressure generating pump 219 are at rest.

Ink in the sub-tank is being consumed along with recording to the recording sheet.

Here, the leading end of the main tube 226 is immersed into ink in the sub-tank 203, while the main tank including the main tube are closed to the air outside with the exception of the tube end. Therefore, even when the liquid level of the sub-tank is lowered due to the ink consumption, no ink is supplied from the main tank to the sub-tank up to this moment.

Then, when ink in the sub-tank 203 is consumed so that the liquid level of ink in the sub-tank 203 is made lower than the height at (E), the conduction between the electrode needles a and b of the ink remain detection sensor 223 is cut off, thus sensing that the ink remains in the sub-tank become smaller (S302).

When this is sensed, the current recording to the recording sheet is provisionally suspended (S303), and after that, the jet head unit 201 is returned to its home position. The jet head unit is capped by means of the cap 217 (S304). Then, the sub-tube closing valve 230 is closed (S305). The air releasing valve 224 is thus closed to make the sub-tank a closed space in the ink supply path (S306).

Subsequently, the negative pressure tube closing valve 231 is open (S307). In this state, the negative pressure generating pump 219 is driven (S308) to cause the air in the sub-tank 203 to be exhausted through the negative pressure tube 237, thus generating negative pressure in the sub-tank 203. In other words, the sub-tank 203 is made a closed space whose inner pressure is reduced. In this way, ink is refilled to the sub-tank 203 from the main tank 202 (S309).

At this juncture, there is no possibility that ink returns from the jet head unit 201 to the sub-tank 203, because the sub-tube closing valve is closed. Also, when ink in the main tank 202 is supplied to the sub-tank 203, the filter 225 fixed to the top end of the main tube 226 functions to remove foreign particles.

Further, in accordance with the present embodiment, the end portion of the main tube in the sub-tank is placed lower than the position where the detection is made to allow the liquid refilling. As a result, the end portion of the main tube is always in ink retained in the sub tank. With this arrangement, ink does not foam in the sub-tank when ink is refilled, making it possible to materialize a stabilized ink refilling. Also, in order to materialize a more stabilized ink refilling, the negative pressure generating pump is driven after the negative pressure tube closing valve is open in accordance with the present embodiment. Therefore, even when suction force is considerably high in the steady state of the refilling operation, it is possible to exhaust the air to the outside from the negative pressure tube without making any abrupt changes in the inner state of the sub-tank at the initial stage of the refilling operation.

As described above, the ink refilling to the sub-tank is performed in accordance with the detected result of ink remain detection means, such as the ink remain detection sensor 223, and ink is refilled only when it is needed. Consequently, it is possible to minimize the idle time in recording operation that may be caused by the ink refilling to the sub-tank.

During the refilling operation, detection is made as to the period of time since the refilling operation begins (S310), and the height of the liquid level (S311) as well. If the liquid level of ink in the sub-tank 203 reaches the height at (F) within a given time to be described later, conduction takes place between the electrode needles a and c of the ink remain detection sensor 223. Hence, it is sensed that a given amount of ink is refilled in the sub-tank.

At this juncture, the negative pressure tube closing valve 231 is closed (S312) to suspend the driving of the negative pressure generating pump 219 (S313). Then, the air releasing valve 224 is open to reliably release the state of reduced pressure in the interior of the sub-tank (S314), thus opening the sub-tube closing valve 230 (S315).

In this way, by suspending the operation of negative pressure generating means before ink flows into the negative pressure tube, the flow resistance in the negative pressure tube from becoming more intensive due to the mixture of ink and air in the negative pressure tube, hence making it possible to use a smaller negative pressure generating pump.

Also, by suspending the operation of the negative pressure generating pump after closing the negative pressure tube closing valve, it is possible to prevent ink from flowing backward even if ink should flow into the negative pressure tube.

In this respect, the driving time of the negative pressure generating pump 219 is predetermined for the ink supply to the sub-tank 203 so that a predetermined amount of ink is sufficiently injected into the sub-tank. Then, if the conduction between the electrode needles a and c of the ink remain detection sensor 223 is not detected even when the negative pressure generating pump 219 is driven for such predetermined period of time, it is determined that there is no ink in the main ink tank 202. An indication is made on the display (not shown) of the recording apparatus main body to that effect. When no ink remains in the main tank 202, the main tank is removed from the joint cap 228 to replace it with a new main tank.

As described above, it is arranged to supply ink from the main tank to the jet head unit through the sub-tank, and at the same time, to provide the negative pressure generating pump to exhaust the air in the sub-tank. With the negative pressure thus generated in the sub-tank by means of the negative pressure generating pump to supply ink from the main tank, there is no need for the provision of any mechanism between the main tank and the sub-tank to allow ink to flow, while arranging a main tank whose capacity is large. Therefore, the structure of the ink supply path can be made simpler, and also, there is a possibility that the creation of dust, oil component, or other foreign particles becomes rare in the ink supply path. As a result, it is possible to materialize the stabilized ink supply with the nozzle clogging that rarely takes place in the jet head unit. Also, with the negative pressure generating pump being installed on the path different from each ink supply path, the numbers of junction on the ink supply path become smaller. Therefore, ink leakage scarcely occurs due to disconnection of tubes or other operational difficulties.

Second Embodiment

Figure 4:
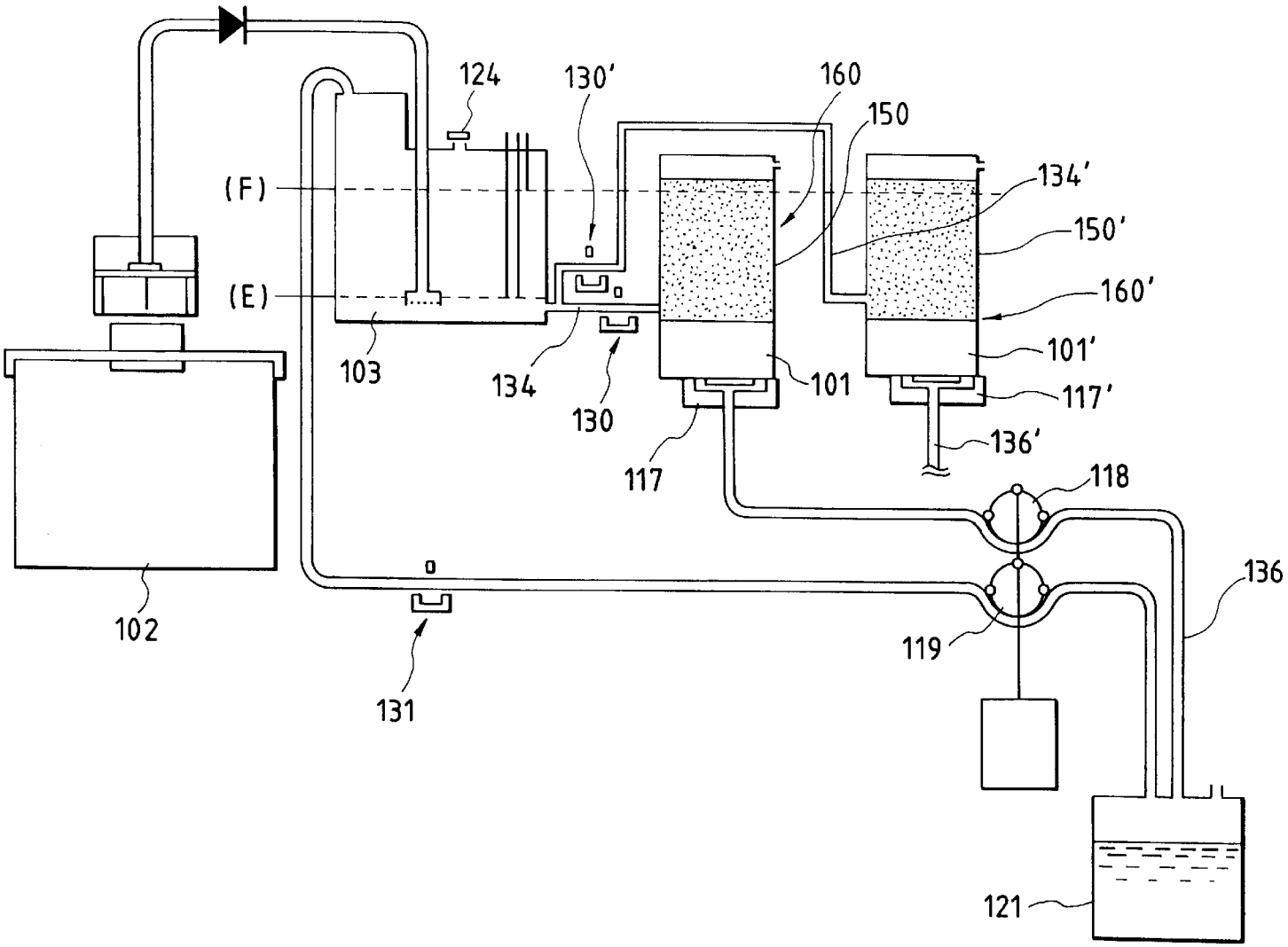
FIG. 4 is a view which shows a second embodiment of the ink path of the liquid jet recording apparatus to which the liquid supplying apparatus of the present invention is applicable.

Now, with reference to FIG. 4, the description will be made of a second embodiment of the liquid jet recording apparatus of the present invention.

In accordance with the present embodiment, what differs from the first embodiment described above is the structure (a head cartridge 160) arranged to house a negative pressure generating member (an ink absorbent) in the jet head unit, and, at the same time, provide a tank unit having a liquid supply section and an air conducting section in it. Further, the present embodiment is such that two head cartridges 160 and 160' are used for recording in ink of the same color. For a sub-tank 103, two head cartridges 160 and 160' are provided. Each of the head cartridges 160 and 160' is mounted on one and the same carriage or on separate carriages that scan in synchronism with each other. These cartridges are arranged at a given gap along the arrangement direction of nozzles of the jet head units 101 and 101'.

Each of the tank units 150 and 150' of the head cartridges 160 and 160' is connected to the sub-tank 103, respectively. In other words, the bottoms of the tank units 150 and 150' are connected to the bottom of the sub-tank 103 through the sub-tubes 134 and 134' having the sub-tube closing valves 130 and 130', respectively.

Also, two caps 117 and 117' are arranged for the jet head units 101 and 101', respectively. Each of the caps 117 and 117' is connected to the waste ink tank 121 through suction tubes 136 and 136', respectively. The suction pump 118, which performs suction recovery of the jet head units 101 and 101' through the caps 117 and 117', may be provided separately for each of the suction tubes 136 and 136' or the pump may be shared by them for use. All the other structures are the same as those of the first embodiment. Therefore, the description thereof will be omitted.

With such arrangement of two head cartridges 160 and 160', it becomes possible to execute the so-called multiple scan recording where the recording is performed, at first, by the jet head unit 101 on the upstream side in the conveying direction of a recording medium in a 50% density, and then, when the portion thus recorded is conveyed to the location of the jet head unit 101' on the downstream side, the same portion is recorded by the jet head unit 101' on the downstream side in the remaining 50% density. Here, if the arrangement length of nozzles is given as L, while the gap between jet head units 101 and 101' is displaced at a length of L/2 of the integral times of the gap L, and a recording medium is also arranged to be conveyed in a pitch of L/2, each joint between lines becomes less conspicuous. In case of a textile printing using cloth as its recording medium, patterns or images are often formed almost all over the entire area of the cloth. Therefore, the effects obtainable by the arrangement described above are particularly significant.

When ink in the sub-tank 103 is consumed along with recording, ink is supplied from the main tank 102 to the sub-tank 103 as in the first embodiment. In other words, each of the jet head units 101 and 101' of the cartridges 160 and 160' is capped by each of the caps 117 and 117'. Then, in this state, the air releasing valve 124, sub-tube closing valves 130 and 130' are closed. At the same time, the negative pressure tube closing valve 131 is open. The negative pressure pump 119 is driven. In this way, negative pressure is generated in the sub-tank 103. With the application of this negative pressure, ink is supplied from the main tank 102 to the sub-tank 103. When a predetermined amount of ink is supplied to the sub-tank 103, the negative pressure tube closing valve 131 is closed to suspend the ink supply operation to the sub-tank 103. The ink supply from the sub-tank to the head cartridge is performed in such a manner as to open the air releasing valve 124, and the sub-tube closing valves 130 and 130' as well when the ink retaining amount in the tank unit becomes lower than a specific amount.

When the ink retaining amount in the sub-tank is sufficiently larger than the ink holding capacity of the head cartridge, the sub-tube closing valve or the air releasing valve is kept open. It should be good enough to conduct the ink supply from the sub-tank to the head cartridge only when the retaining amount in the tank unit becomes lower than a specific amount.

Here, for the present embodiment, the description has been made of the case where two head cartridges 160 and 160' are provided, but it may be possible to apply the present invention to the arrangement of three or more head cartridges. Also, it is possible to set the gap between each of the head cartridges, the recording densities, and the conveying pitches of a recording medium appropriately corresponding to the qualities of images as required.

Also, for the present embodiment, the description has been made of the head cartridge, which is structured with the liquid jet head unit and tank unit as well for the liquid jet head connected to the sub-tank, but as in the first embodiment, it may be possible to arrange a structure so that the liquid jet head is directly connected by use of tubes.

Other Embodiments

The embodiments of the principal part of the present invention have been described as above. Now, the description will be made of the other examples that may be preferably applicable to those embodiments.

In this respect, those described below are applicable to each of the embodiments described above unless otherwise specified.

Negative Pressure Generating Means * Negative Pressure Generating Tube

For each of the embodiments described above, the example is shown, in which a tube pump is used as a pump for the generation of negative pressure in the sub-tank. However, it may be possible to use any type of pumps, not necessarily a tube pump, if only the pump should be able to exhaust the air in the sub-tank, such as a geared pump. If a geared pump is adopted, it may be possible to arrange the geared pump directly on the junction between the sub-tank and the negative pressure tube. In this case, too, the flow resistance in the negative pressure tube is prevented from being intensified due to the mixture of ink and air in the negative pressure tube as in the first embodiment, thus making it possible to obtain a sufficiently desirable speed of ink refilling even with the adoption of a small pump for use of negative pressure generation.

Further, for each of the embodiments described above, one and the same motor is used for driving the negative pressure generating pump and a pump used for executing the suction recovery operation, which will be described later. Here, an arrangement is made to switch it over depending on the usages. However, it may be possible to install each individual motor for different use. In such a case, it becomes possible to execute the liquid refilling operation during the recovery operation to be described later.

Also, it may be possible to adopt a mechanism that depresses tubes by use of a cam as a negative pressure generating tube closing valve. The negative pressure generating tube closing valve can be kept either open or closed except when it is in the refilling operation. However, if the mechanism described above is adopted, it is desirable to keep the closing valve open from the view point of durability except when it is in the refilling operation.

In this respect, if a mode to squeeze tubes is adopted as the mechanism of a closing valve for the negative pressure generating tube, it may be possible to release the valve during the execution of the operation that is not directly related to the negative pressure generation or the like.

Sub-Tank

Figure 5:
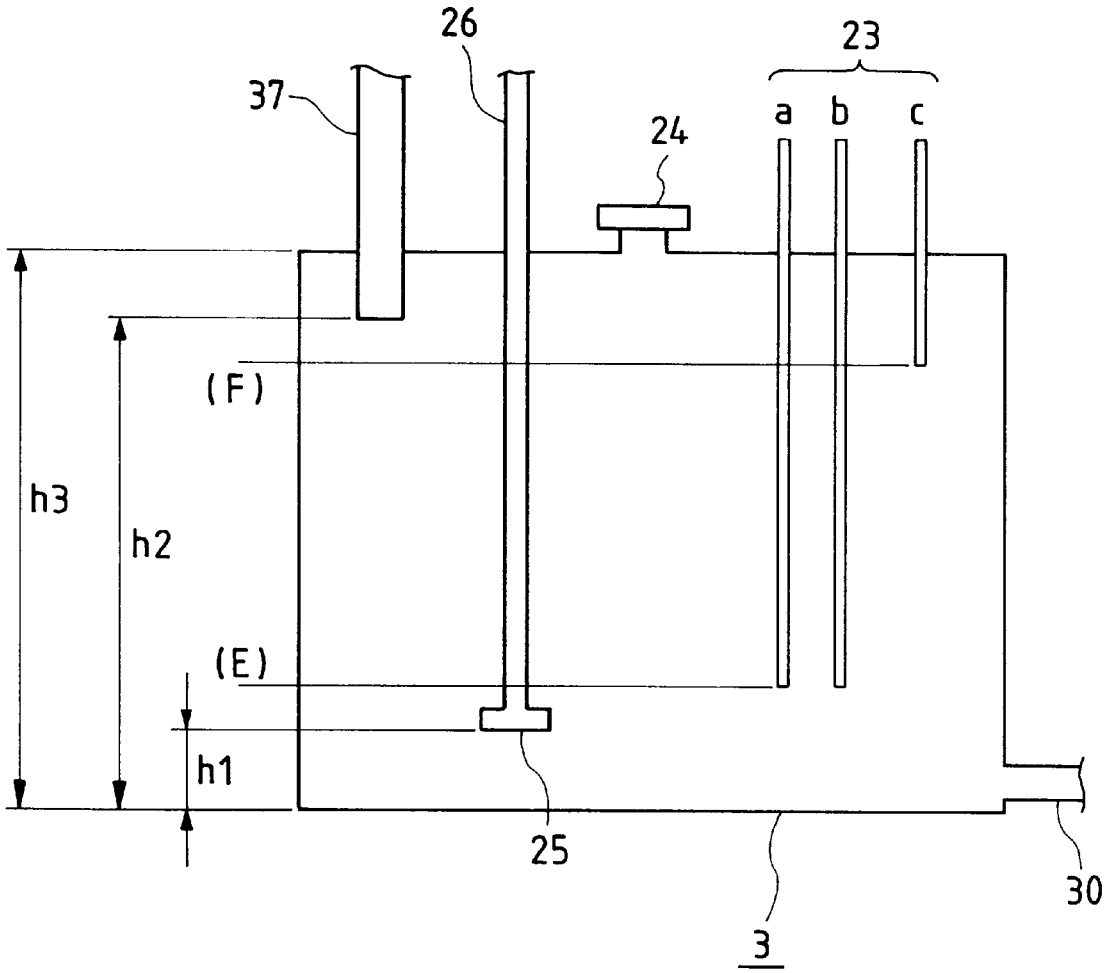
FIG. 5 is a structural view which schematically shows the sub-tank to which the liquid supplying apparatus of the present invention is applicable.

FIG. 5 is a view which shows a sub-tank applicable to the liquid supplying apparatus of the present invention.

As described above for each of the embodiments, the end portion of the main tube is placed lower than the position (E) in the sub-tank in order to sense the necessity of executing liquid refilling. As a result, there is no foaming of ink in the sub-tank when ink is refilled, thus materializing the stabilized ink refilling. Also, the end portion of the negative pressure generating tube is placed higher than the position (F) in order to sense the necessity of suspending liquid refilling. Thus, it is made possible to suspend negative pressure generating means before ink flows into the negative pressure generating tube, and stabilize the execution of liquid refilling efficiently.

As means for detecting the positions of the liquid levels, electrodes are utilized for making detection in each of the embodiments described above. However, the present invention is not necessarily limited to such mode of detection. It may be possible to utilize an optical detection device, among many other modes. Also, it may be possible to measure dot counts or the like as a detection mode to conduct liquid refilling appropriately.

Also, as shown in FIG. 5, the height from the bottom of the tank to the main tube end is defined as h1, the height to the end of the negative pressure tube as h2, and the height to the end of the aperture of the air releasing valve as h3. Then, the relationship is defined as h1<h2 in order to exhaust the air in the sub-tank for effectuating the ink refilling. Further, if the relation is defined as h2<h3, it is possible to prevent ink from overflowing from the sub-tank through the air releasing valve, because liquid is exhausted to the outside by way of the negative pressure tube even when the operation becomes unstable for liquid detection means or the negative pressure generating pump.

Main Tank

For each of the embodiments described above, the main tank is formed by a soft material (such as a flexible case), and it is closed except for the path that connects the main tank and the sub-tank. Therefore, the main tank deforms along with the reduction of ink in the main tank. With a structure of the kind, it is possible to freely set the position of the main tank in a liquid supplying apparatus.

Here, in place of the foregoing arrangement, it may be possible to provide an aperture for the main tank to induce the air outside besides the path that connects it with the sub-tank. In this case, the end portion of the main tube on the main ink tank side should desirably be placed in the lower part of the main tank in order to supply ink in the main tank to the sub-tank reliably. Also, it is necessary to adjust the positions of the main tank and sub-tank in order not to allow ink in the main tank to flow into the sub-tank due to the water head difference. The main tank should be installed in a location lower than that of the sub-tank, for example. On the other hand, if the main tank is arranged to be open to the air outside like this, there is no need for forming the main tank itself by a flexible material. Here, therefore, it is advisable that arrangements should be made as the case may be.

Also, for the main tube that connects the main tube and the sub-tube, it may be possible to adopt a tube, which is arranged to be switchable to plural branches by use of a switching valve on the side where it is connected to the main tank so that the tube can be connected with a plurality of main tanks at a time. In this way, liquid supply can be continuously operated by switching one main tank to another if ink in one tank becomes short. During such period, the used main tank can be replaced with a new main tank. Hence, the ink supply from the main tank to the sub-tank is performed more efficiently.

Recovery Operation

Figure 6:
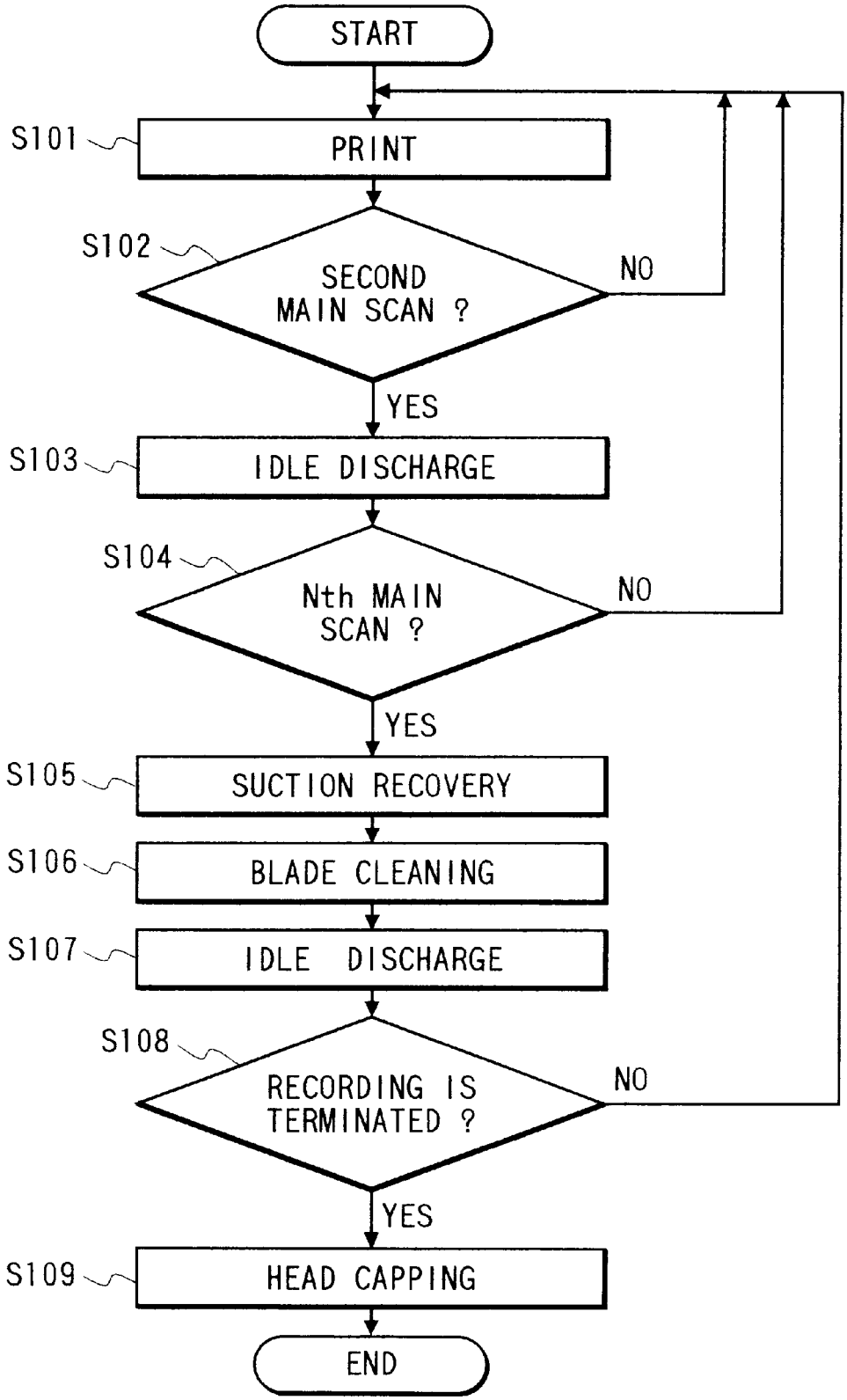
FIG. 6 is a flowchart which shows the recovery operation of the liquid jet recording apparatus of the present invention.

Now, with reference to a flowchart shown in FIG. 6, the description will be made of the recovery operation of the jet head unit 1.

The recovery operation is executed together with the recording operation. At first, the head cartridge 160 scans to print (record) on a recording sheet 15 (S101). When the second scan is completed (S102), an idle discharge is performed (S103), The idle discharge is to discharge ink from all the nozzles to the cap 17 or the like by giving predetermined driving pulses in order to assure the temperature of the area whose temperature is lowered due to liquid and air jet flows, as well as to remove foreign particles in the nozzles. If it is necessary to enhance the wetting condition of the atmosphere surrounding nozzles, the idle discharge may be performed while capping the jet head unit 1. Also, the idle discharge is executed before starting recording operation as aging of the jet head unit 1.

Further, aside from the idle discharge, a suction recovery is executed (S105) per predetermined nth scan (S104). The suction recovery is to remove air bubbles remaining in the nozzles for the maintenance of stabilized discharges. In a state that the jet head unit 1 is capped by cap 17, the suction pump 18 is driven to suck ink compulsorily to cause the air bubbles remaining in the nozzles to be exhausted to the outside. The suction recovery produces good effects on the maintenance of stabilized discharges by washing off the dust particles and feathers adhering to the nozzle surface, and the dust particles residing in the nozzles as well. Ink thus sucked out is carried over to the waste ink tank 21. Here, if the apparatus is left intact for a long time, ink in the nozzles evaporates gradually even if the head is capped, and ink in it becomes overly viscous. Therefore, in order to remove such overly viscous ink, the suction recovery is conducted before starting recording to exhaust it to the outside of the nozzles.

When the suction recovery is completed, a blade cleaning is executed (S106). The blade cleaning is to wipe off the nozzle surface of the jet heat unit 1 by use of the blade 11 which is installed adjacent to the cap 17. With this cleaning, the ink mist or the like, which is generated by ink discharges and caused to adhere to the nozzle surface, is wiped off to maintain the stabilized discharges. In consideration of durability and resistance to ink, the blade 11 is formed by silicone rubber or urethane rubber. Also, the leading end of the blade 11 is placed to step in the nozzle surface of the jet head unit 1 by 0.7 to 1.0 mm. In practice, therefore, the blade 11 wipes off the surface while bending itself to that extent.

When the blade cleaning is completed, the idle discharge is again performed (S107). Each of the operations described above is repeated until recording is completed (S108). When recording is over, the jet head unit 1 is capped by the cap 17 to terminate the recording operation. If the jet head 1 is left intact in the air outside for a long time, ink in the nozzles evaporates and it becomes overly viscous to cause discharges to be unstable. Capping the jet head unit 1 after the termination of recording is to prevent unstable discharges. In the interior of the cap 17, a liquid absorbent is arranged to keep ink in a wet condition, and to maintain the interior of the cap 17 in high humidity to minimize the possibility that ink becomes overly viscous.

With the recovery operation described above, the causes that produces adverse effects on the ink discharges are removed completely, making it possible to execute recording in good condition at all times.

Liquid Jet Recording Apparatus

For each of the embodiments described above, a recording apparatus of a serial scanning type is shown. This apparatus records while the jet head unit reciprocates to scan. Here, the jet head unit may be of a full line type having a length corresponding to the maximum recording width recordable by the recording apparatus that uses such unit.

Also, as liquid applicable to the present invention, ink is exemplified in its description, but among ink jet recording apparatuses, there is the one provided with a jet head for use of preprocessing liquid that discharges the preprocessing liquid, which is prepared to coagulate colorant in ink, before discharging ink in order to enhance its permeability on a recording paper sheet. The present invention is also applicable to such case by arranging the structure of supply path for use of preprocessing liquid the same as those structured for each of the embodiments described above. Particularly, if a structure is made to arrange supplying means, such as a pump, on the supply path for preprocessing liquid, and supply it by use of such means, air bubbles tend to be created easily, resulting in disabled discharges. However, with the application of the present invention, a problem of the kind can be solved effectively.

Further, for each of the embodiments described above, an ink jet recording apparatus is cited for its description, but the present invention is not necessarily limited to the application of an ink jet recording apparatus. For other usages, for example, it is possible to apply the present invention to liquid supply to any other liquid consuming members than the recording head. Also, liquid applicable to the present invention is not necessarily limited to ink and preprocessing liquid, but the present invention is equally applicable to liquid having oiliness in it. Particularly, the invention is effectively applicable to use of liquid for which it is desirable to avoid any mixture of foreign particles in its supply path.

As described above, the method for refilling liquid and the liquid supplying apparatus of the present invention are structured to arrange a sub-tank that holds liquid temporarily in the middle of the liquid supply path, and induces the air outside for the supply of liquid, and then, to make the sub-tank a closed space to refill liquid in it, while reducing pressure in it. With the arrangement thus made, it is possible to supply liquid stably.

Also, negative pressure generating means is provided on a path different from the liquid supply path to reduce pressure in the sub-tank. With this arrangement, the liquid supply path can be structured simply, thus making it possible to reduce the occurrence of ink leakage and other operational difficulties. In this case, since the air in the sub-tank is exhausted to make the sub-tank a closed space having a reduced pressure, it is possible to adopt a pump as means for generating negative pressure. As a result, negative pressure can be generated easily with a simple structure. Further, when liquid in the sub-tank is made suppliable to the downstream side, it is possible to prevent it from flowing backward to the sub-tank from the downstream side of the liquid supply path by arranging to allow only the interior of the tank to be open once to the air outside. In addition, it is possible to minimize the refilling frequencies of liquid to the sub-tank by detecting the liquid remains in the sub-tank, thus stabilizing the liquid refilling.

Particularly, when the liquid supplying method and apparatus of the present invention are applied to the liquid jet recording apparatus, which is provided with the liquid jet head on the downstream end of the liquid supply path, it is possible to attain the provision of a liquid jet recording apparatus the liquid jet head of which rarely creates nozzle clogging.

What is claimed is:

1. A method for refilling liquid to a sub-tank, the liquid being refilled from a main tank of a liquid discharge recording apparatus having a liquid supply path including a liquid discharge recording head for discharging liquid, the sub-tank for temporarily containing liquid and supplying the liquid to the liquid discharge recording head by introducing atmospheric air into the sub-tank, said method comprising the steps of:

closing the liquid supply path between the sub-tank and the liquid discharge recording head of the liquid supply path;

making the sub-tank into a space closed from atmospheric air; and refilling the liquid in the main tank into the sub-tank by reducing pressure in the sub-tank, wherein pressure is reduced in the sub-tank by negative pressure generating means provided in a path different from the liquid supply path.

2. A method for refilling liquid according to claim 1, wherein said negative pressure generating means reduces pressure in the sub-tank by exhausting air in the sub-tank.

3. A method for refilling liquid according to claim 1, wherein said negative pressure generating means suspends pressure reduction before liquid flows into the different path.

4. A method for refilling liquid according to claim 1, further comprising the step of opening the sub-tank to atmospheric air after filling the sub-tank with liquid.

5. A method for refilling liquid according to claim 1, wherein refilling of liquid to said sub-tank is executed by detecting the liquid remaining in said sub-tank.

6. A method for refilling liquid according to any of claims 1, 2, 3, 4, 5, wherein said liquid discharge recording head is for recording on a recording medium by discharging from nozzles liquid supplied from said sub-tank.

7. A liquid discharge recording apparatus, comprising:

a liquid supply path having a liquid discharge recording head for discharging liquid;

a sub-tank for temporarily containing liquid and for supplying the liquid through said liquid supply Path to said liquid discharge recording head by introducing atmospheric air into said sub-tank;

a main tank for containing liquid to be supplied to said sub-tank;

closing means for making said sub-tank into a space closed from atmospheric air; and negative pressure generating means provided in a path different from said liquid supply path to refill the liquid from said main tank into said sub-tank by reducing pressure in said sub-tank;

wherein said closing means includes a valve for opening and closing said liquid supply path between said sub-tank and said liquid discharge recording head, and further includes an openable/closable atmosphere opening valve provided in said sub-tank.

8. A liquid discharge recording apparatus according to claim 7, wherein said negative pressure generating means comprises a pump for exhausting air in said sub-tank.

9. A liquid discharge recording apparatus according to claim 7, wherein an air releasing valve is provided for said sub-tank.

10. A liquid discharge recording apparatus according to claim 7, further comprising means for detecting a liquid amount provided in said sub-tank to determine liquid refilling.

11. A liquid jet recording apparatus comprising:

a liquid jet head unit for recording on a recording medium by discharging liquid;

a sub-tank for holding liquid temporarily and for supplying said liquid to said liquid jet head unit, said sub-tank including an air releasing valve for introducing atmospheric air;

a main tank for storing liquid to be refilled to said sub-tank;

a pump for exhausting air in said sub-tank;

a first liquid supply path for connecting said sub-tank and said main tank;

a second liquid supply path for connecting said liquid jet head unit and said sub-tank;

a valve in said second liquid supply path for controlling the connection between said liquid jet head unit and said sub-tank; and a negative pressure generating path for connecting said sub-tank and said pump, wherein an end portion of said negative pressure generating path on a sub-tank side thereof is positioned higher than an end portion of said first liquid supply path on a sub-tank side thereof.

12. A liquid jet recording apparatus according to claim 11, wherein, when positioned for supply of liquid to said liquid jet head, the air releasing valve of said sub-tank is positioned higher than the end portion of said negative pressure generating path on said sub-tank side.

13. A liquid jet recording apparatus according to claim 11, further comprising a first means for detecting a liquid surface level in the sub-tank provided at a position higher than the end portion of said first liquid supply path on said sub-tank side.

14. A liquid jet recording apparatus according to claim 13, further comprising a second means for detecting a liquid surface level in the sub-tank provided at a position lower than the end portion of said negative generating path on said sub-tank side.

15. A liquid jet recording apparatus according to claim 11, wherein said main tank is a space substantially closed to atmospheric air with the exception of the end portion of said first liquid supply path on said sub-tank side.

16. A liquid jet recording apparatus according to claim 11, further comprising a valve for preventing backward flow in said first liquid supply path.

* * * * *

UNITED STATES PATENT AND TRADEMARK OFFICE

CERTIFICATE OF CORRECTION

PATENT NO. : 5,963,237

DATED : October 5, 1999

INVENTORS : MASATOSHI IKKATAI et al.

It is certified that error appears in the above-identified patent and that said Letters Patent is hereby corrected as shown below:

On the title page, item 56:

References Cited

U.S. PATENT DOCUMENTS

"IIiguma et al." should read --Higuma et al.--

UNITED STATES PATENT AND TRADEMARK OFFICE

CERTIFICATE OF CORRECTION

PATENT NO. : 5,963,237

DATED : October 5, 1999

INVENTORS : MASATOSHI IKKATAI et al.

It is certified that error appears in the above-identified patent and that said Letters Patent is hereby corrected as shown below:

COLUMN 11

Line 67, "160" should read --4--.

COLUMN 12

Line 3, "(S103)," should read --(S103).--.

COLUMN 14

Line 34, "Path" should read --path--.

Signed and Sealed this

Second Day of January, 2001

*Attest:*

*Attesting Officer*

Q. TODD DICKINSON

*Commissioner of Patents and Trademarks*